US007338234B2

(12) United States Patent
Rataj et al.

(10) Patent No.: US 7,338,234 B2
(45) Date of Patent: Mar. 4, 2008

(54) ROCK BOLT

(75) Inventors: Mieczyslaw Stanislaw Rataj, Charlestown (AU); Andrew Boychuk, Cardiff (AU)

(73) Assignee: Dywidag-Systems International Pty Limited, New South Wales (AU)

( * ) Notice: Subject to any disclaimer, the term of this patent is extended or adjusted under 35 U.S.C. 154(b) by 95 days.

(21) Appl. No.: 11/303,895

(22) Filed: Dec. 16, 2005

(65) Prior Publication Data

US 2006/0153645 A1 Jul. 13, 2006

(30) Foreign Application Priority Data

Dec. 20, 2004 (AU) ..... 2004907218

(51) Int. Cl.
*E21D 20/00* (2006.01)

(52) U.S. Cl. ..... 405/259.6; 405/259.5

(58) Field of Classification Search ..... 405/259.1, 405/259.3, 259.5, 259.6
See application file for complete search history.

(56) References Cited

U.S. PATENT DOCUMENTS

| | | | | |
|---|---|---|---|---|
| 4,601,614 | A | 7/1986 | Lane et al. | |
| 4,607,984 | A * | 8/1986 | Cassidy | 405/259.6 |
| 4,820,095 | A * | 4/1989 | Mraz | 405/259.6 |
| 5,051,038 | A | 9/1991 | Smith et al. | |
| 5,387,060 | A | 2/1995 | Locotos | |
| 6,457,910 | B1 * | 10/2002 | Ludwig et al. | 405/259.6 |
| 6,468,010 | B2 * | 10/2002 | Sager et al. | 405/259.5 |
| 6,491,478 | B2 * | 12/2002 | Sager et al. | 405/259.6 |
| 2001/0028833 | A1 | 10/2001 | Sager et al. | |
| 2003/0219316 | A1 * | 11/2003 | Rataj | 405/259.5 |
| 2004/0161316 | A1 * | 8/2004 | Locotos et al. | 405/259.5 |

FOREIGN PATENT DOCUMENTS

| | | |
|---|---|---|
| AU | 30852/77 | 5/1979 |
| AU | 15653/02 | 8/2002 |
| AU | 2004201671 A1 | 5/2004 |
| EP | 0 251 887 A1 | 1/1988 |
| SU | 1580024 A1 | 7/1990 |
| WO | WO-96/07015 | 3/1996 |
| WO | WO-03/044324 | 5/2003 |
| WO | WO-2004/055326 A1 | 7/2004 |

* cited by examiner

*Primary Examiner*—Frederick L. Lagman
(74) *Attorney, Agent, or Firm*—Marshall, Gerstein & Borun LLP

(57) ABSTRACT

A rock bolt (1) comprises a tubular body (4) defining a tubular bore (5) for receiving an adhesive or cement filled cartridge (18). A plug (8) is mounted in the bore (5). The plug (8) is displaceable along the bore (5) and sealingly engages the tubular body (4). A bolt head (7) is located at or adjacent a second end (3) of the rock bolt (1). A detent arrangement (10, 12) restrains the plug (8) in a position adjacent an opening at the first end (2) of the rock bolt (1).

20 Claims, 6 Drawing Sheets

ROCK BOLT

FIELD OF THE INVENTION

The present invention relates to mining equipment, and in particular relates to a rock bolt for securing the roof or wall of a mine, tunnel or other ground excavation.

BACKGROUND OF THE INVENTION

A known method of installing a resin grouted rock bolt to secure the roof or wall of an underground mine, tunnel or other ground excavation involves mounting a two component resin filled cartridge on the upper end of the rock bolt and inserting the assembled resin cartridge and rock bolt into a hole drilled into the rock face. When the resin cartridge reaches the top end of the hole, the upper end of the rock bolt pierces the resin cartridge, enabling the two resin components to be mixed. Mixing of the resin components is typically achieved by rotating the rock bolt within the hole. The mixed resin sets in the annular cavity between the upper end portion of the rock bolt and the wall of the hole in the rock face, thereby anchoring the upper end of the rock bolt.

The resin cartridge is typically mounted on the upper end of the rock bolt by way of a cardboard sleeve mounted concentrically on and extending beyond the upper end of the rock bolt. The resulting assembly of the rock bolt and externally mounted resin cartridge is, however, relatively long, having a length equal to the combined lengths of the rock bolt and the resin cartridge. As a result, such an assembly cannot be utilised in more confined areas such as mines or tunnels having a low roof height, as there is insufficient room to manoeuvre the assembly on a rock bolt installation rig and align it with the hole in which the assembly is to be inserted. Further, externally mounted resin cartridges are prone to damage during maneuvering of the rock bolt installation rig within the mine/tunnel and during installation of the rock bolt assembly itself.

Alternate rock bolts have been proposed that are of a tubular form, allowing a resin cartridge to be mounted within the hollow body of the rock bolt. A resin cartridge rupturing device is located in the hollow body above the resin cartridge. Formations on the inner wall of the hollow body between the rupturing device and the open upper end of the rock bolt form a static mixing device which serve to mix resin passing therethrough. The tubular rock bolt is inserted into the hole with a plunger extending from the lower end using a typical rock bolt installation rig. Once the rock bolt is placed in position, the plunger is forced through the rock bolt hollow body, forcing the resin cartridge against the rupturing device, thereby rupturing the cartridge and extruding the two component resin through the static mixing device formations on the interior wall of the rock bolt. Mixed resin then flows out of the end of the rock bolt and into the annular cavity between the rock bolt and the hole wall, where it sets so as to secure the end of the rock bolt. The static mixing device and cartridge rupturing device, are, however subject to blockage from fragments of the ruptured casing of the resin cartridge, thereby inhibiting the flow and adequate mixing of the two component resin. Further, given that the plunger typically needs to be mounted in the rock bolt prior to insertion with a standard rock bolt installation rig, the assembly of the rock bolt and plunger suffers from the same disadvantages of excess length discussed above in relation to rock bolt assemblies having externally mounted resin cartridges.

OBJECT OF THE INVENTION

It is the object of the present invention to overcome or substantially ameliorate at least one of the above disadvantages.

SUMMARY OF THE INVENTION

There is disclosed herein a rock bolt having a first end and a second end, said rock bolt comprising:

a tubular body defining a tubular bore for receiving an adhesive or cement filled cartridge, said bore extending from an opening at said rock bolt first end towards said rock bolt second end, said bore communicating with the exterior of said rock bolt at or adjacent said rock bolt second end;

a plug mounted in said bore, said plug being displaceable along said bore and sealingly engaging said tubular body so as to seal said bore;

a bolt head located at or adjacent said rock bolt second end; and a detent arrangement adapted to restrain said plug in a position adjacent said rock bolt first end.

The rock bolt may further comprise a locking formation for locking said rock bolt second end to an installation device.

The locking formation may be in the form of a bayonet-type fitting.

Alternatively, said locking formation may be in the form of a thread.

In one form, said rock bolt first end defines an end face that is inclined at an acute angle to a longitudinal axis of said rock bolt.

The tubular body may extend to said rock bolt second end.

The bolt head may be in the form of a collar fixed to or integrally formed with said tubular body.

Alternatively, said rock bolt may further comprise a threaded rod extending between said tubular body and said rock bolt second end, said bolt head being in the form of a nut threadingly received on said threaded rod, said threaded rod being provided with a passage communicating said bore with the exterior of said rock bolt at or adjacent said rock bolt second end.

The detent arrangement may comprise a spring clip mounted on said plug.

The detent arrangement may further comprise a groove in said tubular body adapted to engage said spring clip.

The detent arrangement may alternatively further comprise a restriction at said opening, said restriction being configured to allow said plug to pass only partially through said opening with said spring clip located outside of said tubular body.

There is further disclosed herein a rock bolt assembly comprising:

a rock bolt as defined above; and an adhesive or cement filled cartridge received in said bore of said rock bolt.

Typically, said cartridge comprises a first chamber filled with a first component of a two component resin adhesive and a second chamber filled with a second component of said two component resin adhesive.

There is further disclosed herein a method of securing a rock face in a mine, tunnel or other ground excavation, said method comprising the steps of:

drilling a hole in said rock face;

providing a rock bolt as defined above;

locating an adhesive or cement filled cartridge in said bore of said rock bolt;

inserting said rock bolt into said hole with said rock bolt first end leading;

applying fluid pressure to said bore between said plug and said rock bolt second end, thereby displacing said plug along said bore toward said rock bolt first end and ejecting said cartridge from said bore opening;

restraining said plug in a position adjacent said rock bolt first end;

driving said rock bolt toward an end wall of said hole, thereby rupturing said cartridge between said end wall and said rock bolt first end;

rotating said rock bolt to thereby mix said adhesive or cement;

engaging said rock bolt head with said rock face; and allowing said adhesive or cement to set.

Typically, said cartridge comprises a first chamber filled with a first component of a two component resin adhesive and a second chamber filled with a second component of said two component resin adhesive.

Typically, said rock bolt head engages said rock bolt face via a support plate located therebetween.

Typically, said rock bolt is inserted into said rock bolt hole using an installation device locked onto said rock bolt second end.

Typically, fluid pressure is applied to said bore through said installation device.

There is further disclosed herein a rock bolt system comprising:

a rock bolt as defined above;

an adhesive or cement filled cartridge located in said bore; and a rock bolt installation device, adapted to engage said rock bolt at or adjacent said rock bolt second end, pressurize said bore and rotate said rock bolt.

BRIEF DESCRIPTION OF THE DRAWINGS

Preferred forms of the present invention will now be described by way of example with reference to the accompanying drawings, wherein.

DETAILED DESCRIPTION OF THE PREFERRED EMBODIMENTS

Figure 1:
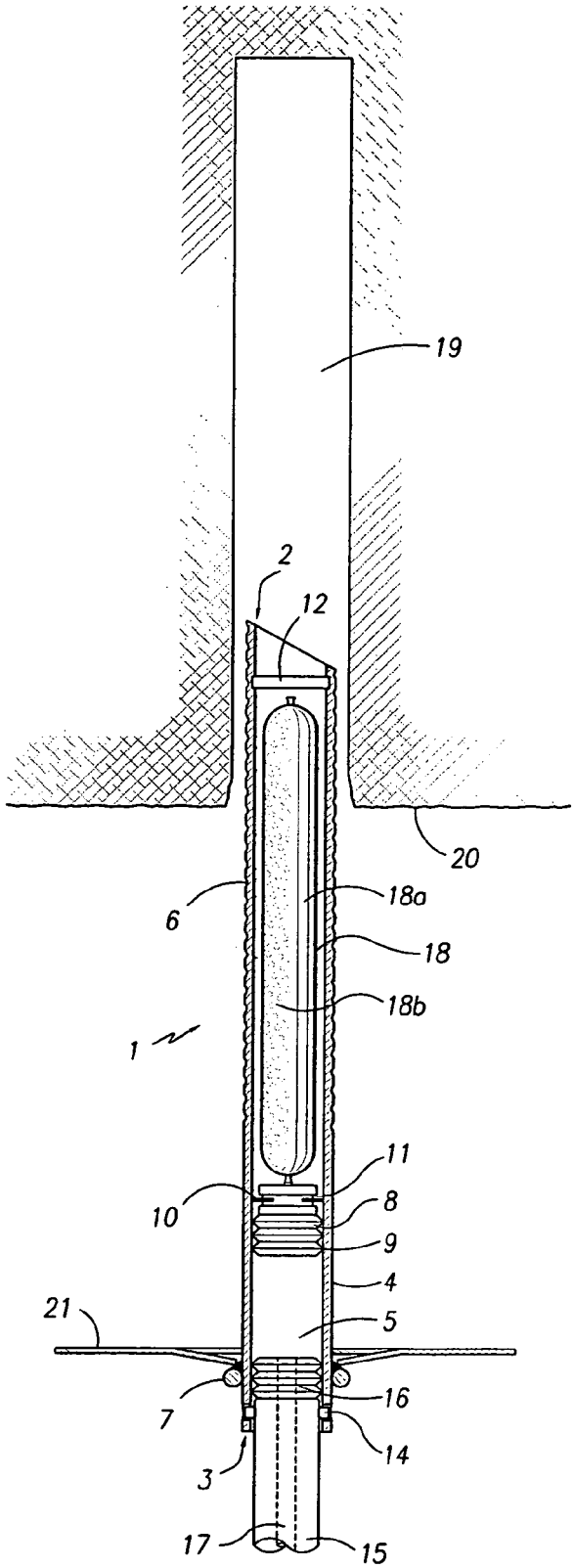
FIG. 1 is a partially cross sectioned front elevation view of a rock bolt assembly immediately prior to installation.
Figure 2:
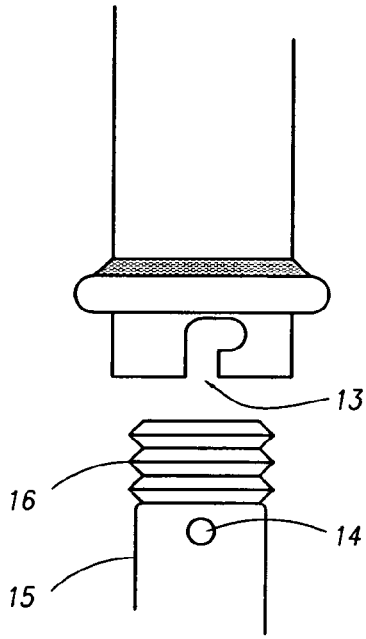
FIG. 2 is a fragmentary front elevation view of the second end of the rock bolt of the assembly of FIG. 1.
Figure 3:
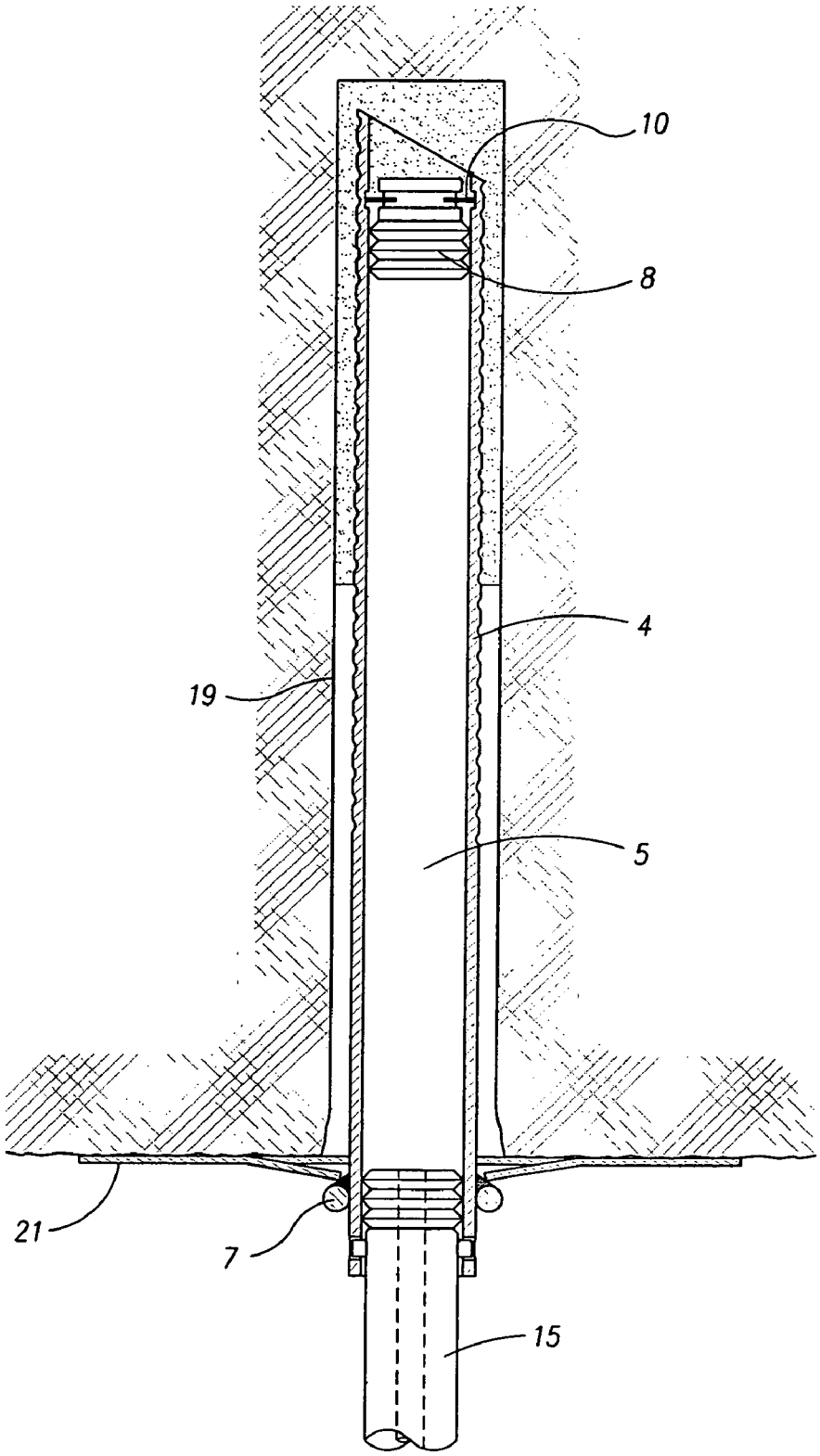
FIG. 3 is a partially cross sectioned view of the rock bolt assembly of FIG. 1 after installation.

Referring specifically to FIGS. 1 to 3, a rock bolt 1 has a first (upper) end 2 and a second (lower) end 3. The rock bolt has a tubular body 4 defining a tubular bore 5. The bore 5 has a substantially constant cross-section throughout its length. The tubular body 4 is typically formed of a steel tube. The tubular body 4 here extends from an opening at the rock bolt first end 2 to the rock bolt second end 3. Helical thread like deformations 6 are formed on the outer surface of the tubular body 4, typically by a rolling process.

A bolt head 7 is located at or adjacent the rock bolt second end 3. Here the bolt head 7 is in the form of an annular collar fixed to the tubular body 4, typically by welding.

A plug 8 is mounted in the bore 5. The plug 8 is displaceable along the bore 5 and is configured to sealingly engage the tubular body 4 so as to seal the bore 5. The plug 8 is typically formed of an elastomeric material with a series of annular ridges 9 to ensure integrity of the seal. A retainer spring clip 10 formed of spring steel is located in an annular groove 11 formed on the plug 8. The spring clip 10 is spring biased against the wall of the tubular body 4. A corresponding annular groove 12 is formed in the wall of the tubular body 4 toward the rock bolt first end 2. The rock bolt first end 2 defines an end face that is inclined at an acute angle to a longitudinal axis of the rock bolt 1. The spring clip 10 and annular groove 12 form a detent arrangement to restrain the plug 8 in a position adjacent the rock bolt first end 2.

Locking formations in the form of a bayonet-type fitting 13 are formed in the tubular body 4 at the rock bolt second end 3. The bayonet-type fitting comprises inverted "L" shaped slots formed on diametrically opposed sides of the rock bolt second end 3. The slots of the bayonet-type fitting 13 are configured to engage pins 14 protruding from diametrically opposed sides of the installation chuck 15 of a rock bolt installation device configured for use with the rock bolt 1. The end of the installation chuck 15 is provided with a seal 16 that is sized to be inserted into the rock bolt bore 5 at the rock bolt second end 3 and seal the bore 5. A fluid delivery aperture 17 extends through the installation chuck 15 and opens onto the end face of the seal 16.

Rather than locking the installation chuck 15 onto the rock bolt second end 3 using the bayonet-type fitting 13, the installation chuck 15 could be configured with a locking arrangement to directly grip the tubular body 4 by expanding inside the bore 5. The chuck could be configured to expand upon rotation relative to the rock bolt second end by a known cam or tapered thread system. With such an installation chuck, there would be no need for a locking formation on the rock bolt 1. The installation chuck 15 could alternatively be configured to fit over the outside of the rock bolt tubular body 4 and lock onto the exterior of the rock bolt. A locking arrangement of any suitable configuration, including for example a clamping arrangement, may be provided on the installation chuck to suit in place of the pin locking arrangement discussed above.

In use, an adhesive or cement filled resin cartridge 18 is located in the bore 5 of the tubular body 4 of the rock bolt 1 between the plug 8 and the rock bolt second end 2 as depicted in FIG. 1. The cartridge 18 is typically a well known resin cartridge 18 having a thin plastic housing and first and second isolated chambers 18*a*, 18*b* housing first and second components of a two-component resin adhesive system as is known in the art. Alternatively (or additionally), the cartridge 18 may house a cement grout. More than one cartridge 18 may also be housed within the bore 5 if so desired.

To stabilise a rock face in a mine, tunnel or other ground excavation, a rock bolt hole 19 is drilled into the rock face 20.

A resin cartridge 18 is mounted in the rock bolt bore 5, and a support plate 21 is located on the rock bolt 1 adjacent the collar 7 in the usual manner. The rock bolt assembly consisting of the rock bolt 1, resin cartridge 18 and support plate 21 is mounted on an installation rig incorporating the installation chuck 15. The seal 16 of the installation chuck 15 is inserted into the rock bolt second end 3 with the pins 14 aligned with the slots of the bayonet-fitting 13. When the pins 14 reach the end of the slots, the rock bolt 13 is rotated so as to lock the bayonet-type fitting onto the pins 14, thereby locking the rock bolt second end onto the installation device chuck 15 as depicted in FIG. 1. The installation chuck seal 16 sealingly engages the walls of the tubular body 4, such that the portion of the bore 5 between the installation chuck 15 and the plug 8 is sealed.

The installation rig is then manoeuvred to locate the rock bolt first end 2 at the opening of the rock bolt hole 19 and the installation chuck 15 extended to insert the rock bolt into the rock bolt hole 19. Once the rock bolt 1 is at least partially inserted into the hole 19, a fluid (typically water or compressed air) is injected under pressure into the bore 5 through the fluid delivery aperture 17 in the installation chuck 15. The fluid pressure within the bore 5 displaces the plug 8 towards the bolt first end 2, ejecting the resin cartridge 18 from the opening in the rock bolt bore 5 into the end of the rock bolt hole 19. Forming the bore 5 with a substantially constant cross section (free of obstructions) ensures the cartridge 18 is ejected intact.

As the plug 8 moves towards the rock bolt first end 2, the spring clip 10 cooperates with the groove 12 in the wall of the rock bolt tubular body 4 to form a detent limiting displacement of the plug 8. The spring clip 10 expands radially and into the groove 12, thereby restraining the plug 8 at a position adjacent the rock bolt first end 2 as depicted in FIG. 3.

The resin cartridge 18 will typically be ejected into the upper end of the bolt hole 19 once the rock bolt 1 has only been partially inserted into the rock bolt hole 19. The cartridge 18 sits in the rock bolt hole 19 above the rock bolt 1 until the rock bolt 1 is driven towards the end wall of the rock bolt hole 19 with the collar 7 engaging the rock face 20 via the support plate 21. The resin cartridge 18 is compressed between the rock bolt first end (and plug 8) and the end wall of the rock bolt hole 19, thereby rupturing the cartridge 18. The spring clip 18 and groove 12 restrain the plug 8 in place as the cartridge 18 is compressed and ruptured, such that the plug (and resin) are not pushed back into the rock bolt tubular body 4.

Alternatively, it is envisaged that the resin cartridge 18 may be driven by fluid pressure out of the rock bolt bore 5 opening once the rock bolt 1 has been driven toward the end of the rock bolt hole 19, such that ejection of the resin cartridge 18 drives it directly against the end wall of the rock bolt hole 19, rupturing the resin cartridge against the end wall of the rock bolt hole 19. Further driving of the rock bolt 1 will typically be required to extrude the resin between the rock bolt 1 and the wall of the rock bolt hole 19.

To assist the operator of the installation rig to determine when the fluid pressure has driven the plug 8 into its restrained position at the groove 12, a relief valve may be provided on the installation chuck. Alternatively, a pressure gauge may be provided for this purpose. Once the plug 8 is restrained, the fluid pressure is relieved.

Once the resin cartridge 18 is ruptured, the resin will tend to flow into the annular cavity between the rock bolt tubular body 4 and the side wall of the rock bolt hole 19. Restraining of the plug 8 adjacent the rock bolt first end 2 will prevent resin escaping down through the bore 5 of the rock bolt 1. The installation chuck 15 is then used to rotate the rock bolt (typically in an anti-clockwise direction, when viewed from below, unlocking the pins 14 within the bayonet-type fitting 13 in preparation for removal of the chuck 15) so as to mix the two components of the resin. Rotation of the rock bolt usually commences as the rock bolt 1 is still being driven towards the top of the rock bolt hole 19. An upward driving force is continued to be applied by the installation chuck 15 during rotation of the rock bolt 1, bearing the collar 7 and support plate 21 against the rock face 20. The inclined end face of the rock bolt first end 2 assists in complete destruction of the casing of the resin cartridge 18 by shreading as the rock bolt is rotated, enabling free flow of the resin. The thread like helical projections 6 on the tubular body 4 assist in mixing of the resin in the annular cavity between the rock bolt tubular body 4 and the side wall of the hole 19, and provide a "keying" effect for the resin bonding to the rock bolt 1, thereby increasing the pull out bond strength.

Once the mixing of the resin is complete, the rock bolt is held in position with the collar 7 and support plate 21 forced against the rock face 20 whilst the resin sets. The installation chuck 15 is then removed, leaving the rock bolt set in place.

Figure 4:
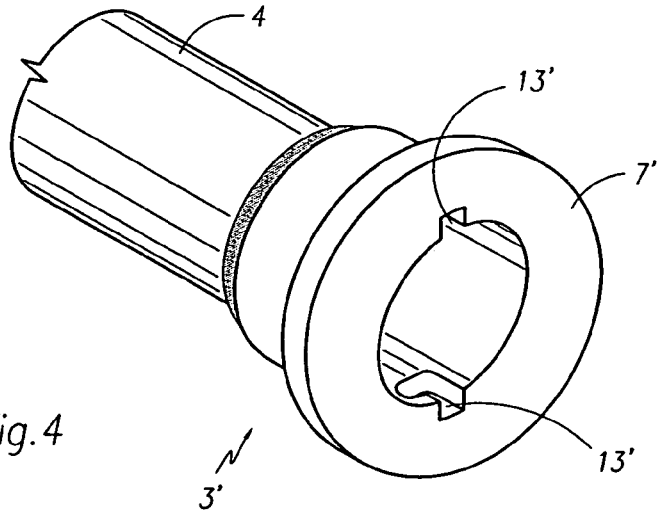
FIG. 4 is a perspective view of an alternate configuration of the second end of a rock bolt.

FIG. 4 depicts an alternate second end 3' configuration of a rock bolt otherwise configured as per the rock bolt of FIGS. 1 to 3. The rock bolt second end 3' is formed as a separate casting that is welded onto the tubular body 4. The cast second end 3' incorporates an integral collar 7' and bayonet-type fitting 13'.

Figure 5:
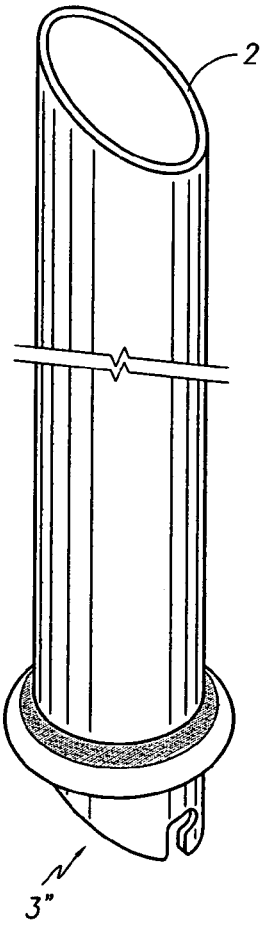
FIG. 5 is a perspective view of another alternate configuration of the second end of a rock bolt.

Another alternate configuration for a bolt second end 3" is depicted in FIG. 5. Here the bolt second end 3" is of the same general configuration as that of the rock bolt of FIGS. 1 to 3, however the rock bolt second end 3" is inclined at an acute angle to the longitudinal axis of the rock bolt the same as the rock bolt first end 2. This allows sections of tubular body 4 for forming the rock bolt to be formed from a single tube with successive angled cuts without the waste of any offcuts or requirement for an additional cut to form a perpendicular end face at the rock bolt second end.

Figure 6:
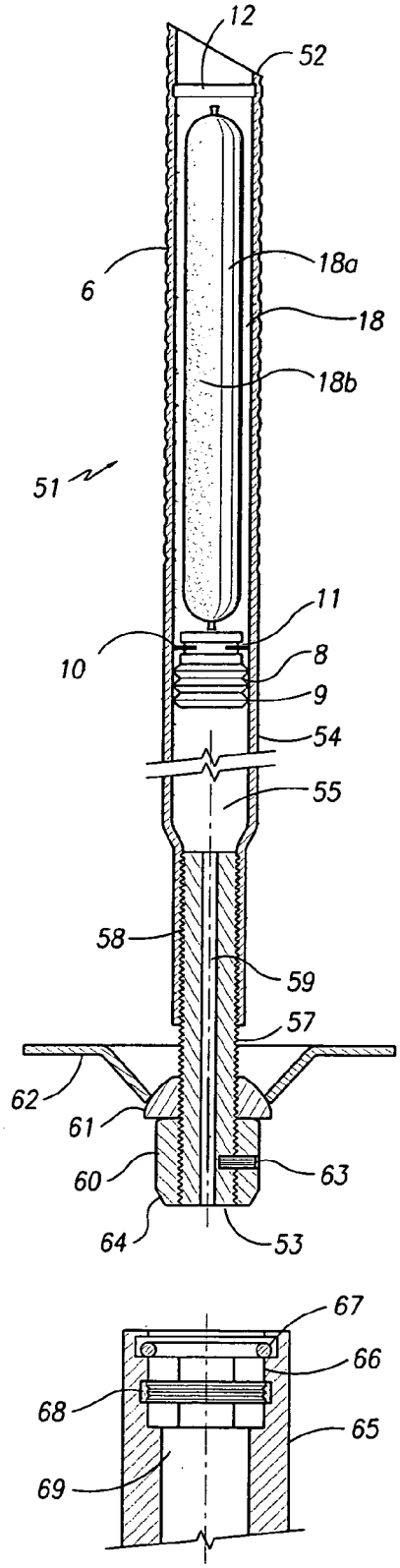
FIG. 6 is a partially cross sectioned front elevation view of another rock bolt and installation chuck.

FIG. 6 depicts an alternate rock bolt assembly including a rock bolt 51 of a similar general form to that disclosed in Australian Patent Application No. 15653/02.

The rock bolt 51 includes a tubular body 54 defining a tubular bore 55. The tubular body 54 extends from an opening at the rock bolt first end 52 towards the rock bolt second end 53, however it does not extend the full length to the rock bolt second end 53. Instead, the rock bolt 51 further includes a threaded rod 57 extending between the tubular body 54 and the rock bolt second end 53. The tubular body 54 is typically swaged onto the upper end portion 58 of the threaded rod 57. The threaded rod 57 is provided with a passage 59 extending through its length which communicates the tubular body bore 55 with the exterior of the rock bolt 51 at the rock bolt second end 53. A plug 8 and resin cartridge 18 are located in the tubular bore 55 in the same manner as in the rock bolt assembly of FIGS. 1 to 3. Similarly, a groove 12 is provided in the wall of the tubular body 54 adjacent the rock bolt first end 52 for engaging the spring clip 10 mounted on the plug 8.

The addition of the threaded rod 57 enables a drive head in the form of a nut 60 to be used to pretension the rock bolt 51 once the rock bolt upper end 52 has been secured in the rock bolt hole with resin in the usual manner. The nut 60 is threaded onto the threaded rod 57 beneath a cup washer 61 and support plate 62 in the usual manner for threaded bar type rock bolts. The nut 60 is fixed to the threaded rod 57 by way of a shear pin 63 in the known manner.

The rock bolt 51 is installed using an installation device including an installation chuck 65 having a drive socket 66 configured to receive the drive nut 60. The drive nut 60 has a chamfered end 64 for ease of insertion into the installation chuck socket 66. An annular seal 68 is provided in the installation chuck socket 66 so as to seal the interface between the outer drive surfaces of the nut 60 and the walls of the installation chuck socket 66. The installation chuck drive socket 66 is further provided with a spring clip 67 which serves to hold the nut 60 during the application of fluid pressure during installation. A fluid delivery aperture 69 extends through the installation chuck and socket 66 thereof for delivery of fluid pressure through the threaded rod passage 59 and into the tubular bore 55 for driving the plug 8 and cartridge 18 towards the rock bolt first end 52.

In use, the rock bolt assembly is mounted in the installation chuck 65 and the rock bolt first end 52 inserted into a rock bolt hole in the manner described above. Fluid pressure is applied through the installation chuck and threaded rod passage 59 to the tubular bore 55, driving the plug 8 and cartridge 18 in the same manner as also described above. The installation chuck 65 rotates the rock bolt 51 to mix the resin by rotating the drive nut 60. The shear pin 63 ensures that the torque applied to the nut 60 by the installation chuck 65 results in rotation of the entire rock bolt 51 rather than rotation of the drive nut 60 along the threaded rod 57. Once the resin mixed by rotation of the rock bolt 51 starts setting and reaches a predetermined viscosity, the torque required to rotate the rock bolt 51 in the setting resin will be such that the shear pin 63 fails. Further rotation of the drive nut 60 accordingly results in threadingly driving the drive nut 60 along the threaded rod 57, thereby applying a compressive force to the rock face via the cup washer 61 and support plate 62 so as to pretension the rock bolt 51. This described configuration of rock bolt 51 is thus more suitable than the rock bolt 1 depicted in FIGS. 1 to 3 where any significant pretension loads are desired.

Figure 7:
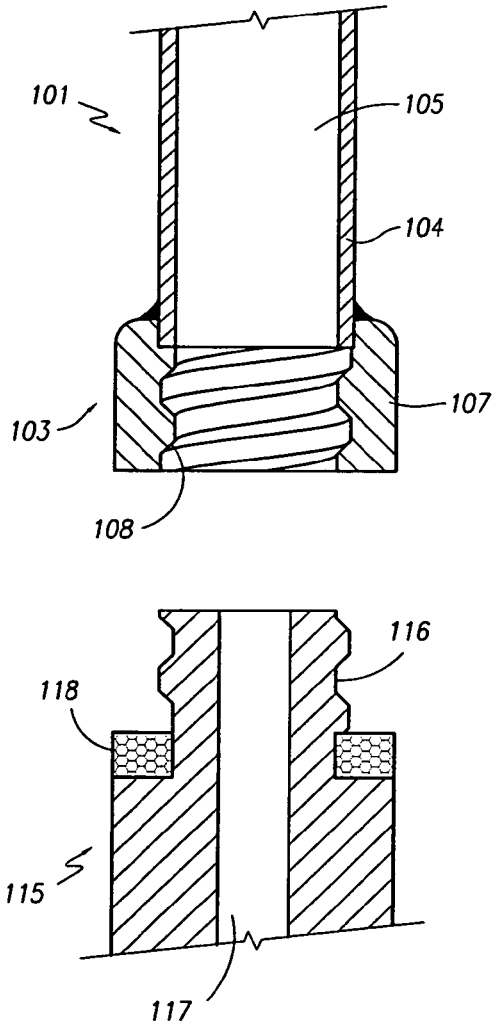
FIG. 7 is a cross sectioned front elevation view of a further alternate configuration of the second end of a rock bolt and a cooperating installation chuck.

FIG. 7 depicts another alternate configuration for the second end 103 of a rock bolt 101 that is otherwise configured as per the rock bolt 1 of FIGS. 1 to 3. The rock bolt second end 103 is provided with a thicker drive head collar 107 that is welded onto the rock bolt tubular body 104. The collar 107 is provided with a threaded internal wall 108. A cooperating installation chuck 115 has an externally threaded end portion 116 that is threadingly received in the collar 107 so as to secure the rock bolt 101 during fluid pressurisation of the tubular body bore 105 via the installation chuck fluid delivery aperture 117. An annular seal 118 defining an annular shoulder adjacent the installation chuck end portion 115 seals against the end face of the collar 107. The threaded connection between the installation chuck 115 and collar 107 also transmits the torque required for rotation of the rock bolt 101 during mixing of the resin. Once the rock bolt 101 has been installed and the resin set, the installation chuck 115 is rotated in the reverse direction so as to disconnect the installation chuck 115 from the collar 107.

Figure 8:
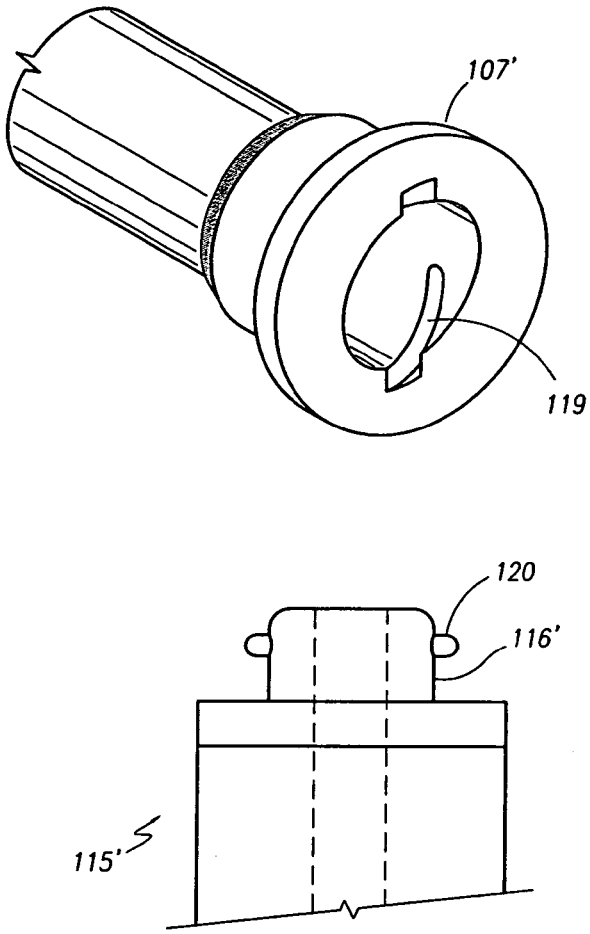
FIG. 8 is a cross sectioned front elevation view of a still further alternate configuration of the second end of the rock bolt and a cooperating installation chuck.

In a similar configuration depicted in FIG. 8, the collar 107' is provided with two opposing helical grooves 119 which engage pins 120 extending laterally from opposing sides of the end portion 116' of the installation chuck 115', rather than utilising a full helical thread as per the configuration of FIG. 7. The installation chuck 115' of FIG. 8 may also be used with the fully threaded collar 107 of the rock bolt 101 of FIG. 7.

Figure 9:
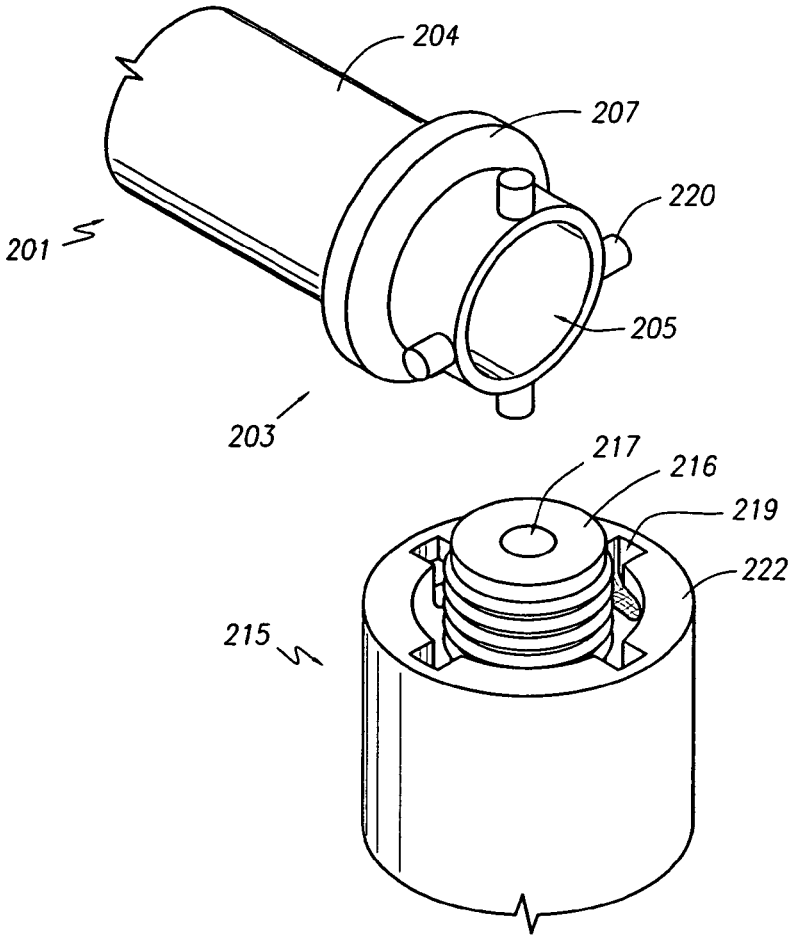
FIG. 9 is a perspective view of another alternate configuration of the second end of the rock bolt and a cooperating installation chuck.

FIG. 9 depicts yet another alternate configuration for the second end 203 of a rock bolt 201 that is otherwise configured as per the rock bolt 1 of FIGS. 1 to 3. The rock bolt second end 203 is provided with a bolt head 207 in the form of an annular collar welded onto the tubular body 204. Pins 220 protrude radially from the rock bolt second end 203. The installation chuck 215 is provided with a seal 216 that is sized to be inserted into the rock bolt bore 205 of the rock bolt second end 203 and seal the bore 205. A fluid delivery aperture 217 extends through the installation chuck 215 and opens onto the end face of the seal 216. The seal 216 is surrounded by an annular wall 222 of the installation chuck 215. "L" shaped slots 219 are formed on the inner face of the annular wall 222 for engaging with the pins 220 so as to form a bayonet-type fitting to secure the rock bolt 201 to the installation chuck 215 with the seal 216 in place within the rock bolt bore 205.

Figure 10:
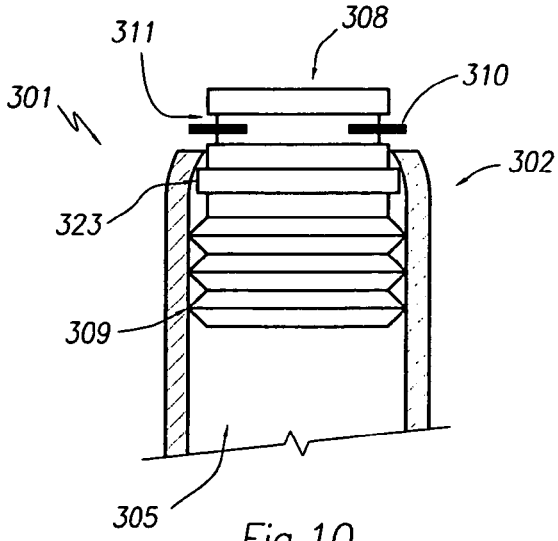
FIG. 10 is a partially cross sectioned view of an alternate configuration of the first end of the rock bolt and plug.

An alternate configuration of the first end 302 of a rock bolt 301 and plug 308 is depicted in FIG. 10. The remainder of the rock bolt 301 may be generally otherwise configured as per any of the rock bolts described above. At the opening defined at the rock bolt first end 302, the tubular body 304 is crimped to form a restriction such that the diameter of the opening is slightly smaller than the diameter of the remainder of the bore 305. The plug 308 is provided with a retainer spring clip 310 formed of spring steel, located in an annular groove 311 formed at a leading end of the plug 308, in a similar manner to the spring clip 10 of the plug 8 of the rock bolt 1 of FIGS. 1 to 3. The plug 308 is also typically formed of elastomeric material with a series of annular ridges 309 toward the trailing end of the plug 308 to ensure integrity of the seal between the plug 308 and the wall of the tubular body 304. The plug 308 is also provided with a collar 323 located between the retainer clip 310 and the annular ridges 309. The restriction at the opening of the bore 305 is sized such that the leading end of the plug 308 is able to pass through the opening with the spring clip 310 outside of the bore 305 beyond the rock bolt first end 302. The opening of the bore 305 is sufficiently narrow such that the remainder of the plug is not able to pass therethrough. Particularly, the opening of the bore 305 has a diameter less than that of the collar 323. Accordingly, once the plug 308 is advanced to the rock bolt first end 302, the spring clip 310 passes beyond the rock bolt first end 302, springing open so as to prevent the plug 308 from being pushed back into the bore 305 engaging the end face of the rock bolt tubular body 304 upon the application of any pressure to the leading end of the plug 308. Accordingly, when compressing the resin cartridge 18 between the rock bolt 301 and the end face of a rock bolt hole 19 as described above, the plug (and resin) are not pushed back into the bore. The collar 323 engaging the crimped end of the tubular body 304 prevents the plug 308 from passing right through the opening, such that the plug 308 is effectively restrained in position adjacent the rock bolt first end 302. Rather than forming the restriction by crimping the tubular body 304 at the rock bolt first end 302, the restriction may be formed by indenting the tubular body 304 to form two or more inwardly projecting protrusions.

The person skilled in the art will appreciate that various other modified forms of rock bolt and installation chuck may also be utilised.

The invention claimed is:

1. A rock bolt having a first end and a second end, said rock bolt comprising: a tubular body defining a tubular bore for receiving an adhesive or cement filled cartridge, said bore extending from an opening at said rock bolt first end towards said rock bolt second end, said bore communicating with the exterior of said rock bolt at or adjacent said rock bolt second end; a plug mounted in said bore, said plug being displaceable along said bore and sealingly engaging said tubular body so as to seal said bore; a bolt head located at or adjacent said rock bolt second end; and a detent arrangement adapted to restrain said plug in a position adjacent said rock bolt first end.

2. The rock bolt of claim 1 wherein said rock bolt further comprises a locking formation for locking said rock bolt second end to an installation device.

3. The rock bolt of claim 2 wherein said locking formation is in the form of a bayonet-type fitting.

4. The rock bolt of claim 2 wherein said locking formation is in the form of a thread.

5. The rock bolt of claim 1 wherein said rock bolt first end defines an end face that is inclined at an acute angle to a longitudinal axis of said rock bolt.

6. The rock bolt of claim 1 wherein tubular body extends to said rock bolt second end.

7. The rock bolt of claim 1 wherein said bolt head is in the form of a collar fixed to or integrally formed with said tubular body.

8. The rock bolt of claim 1 wherein said rock bolt further comprises a threaded rod extending between said tubular body and said rock bolt second end, said bolt head being in the form of a nut threadingly received on said threaded rod, said threaded rod being provided with a passage communicating said bore with the exterior of said rock bolt at or adjacent said rock bolt second end.

9. The rock bolt of claim 1 wherein said detent arrangement comprises a spring clip mounted on said plug.

10. The rock bolt of claim 9 wherein said detent arrangement further comprises a groove in said tubular body adapted to engage said spring clip.

11. The rock bolt of claim 9 wherein said detent arrangement further comprises a restriction at said opening, said restriction being configured to allow said plug to pass only partially through said opening with said spring clip located outside of said tubular body.

12. A rock bolt assembly comprising: a rock bolt as defined in claim 1; and an adhesive or cement filled cartridge received in said bore of said rock bolt.

13. The rock bolt assembly of claim 12 wherein said cartridge comprises a first chamber filled with a first component of a two component resin adhesive and a second chamber filled with a second component of said two component resin adhesive.

14. A method of securing a rock face in a mine, tunnel or other ground excavation, said method comprising the steps of: drilling a hole in said rock face; providing a rock bolt as defined in claim 1; locating an adhesive or cement filled cartridge in said bore of said rock bolt; inserting said rock bolt into said hole with said rock bolt first end leading; applying fluid pressure to said bore between said plug and said rock bolt second end, thereby displacing said plug along said bore toward said rock bolt first end and ejecting said cartridge from said bore opening; restraining said plug in a position adjacent said rock bolt first end; driving said rock bolt toward an end wall of said hole, thereby rupturing said cartridge between said end wall and said rock bolt first end; rotating said rock bolt to thereby mix said adhesive or cement; engaging said rock bolt head with said rock face; and allowing said adhesive or cement to set.

15. The method of claim 14 wherein said cartridge comprises a first chamber filled with a first component of a two component resin adhesive and a second chamber filled with a second component of said two component resin adhesive.

16. The method of claim 14 wherein said rock bolt head engages said rock bolt face via a support plate located therebetween.

17. The method of claim 14 wherein said rock bolt is inserted into said rock bolt hole using an installation device locked onto said rock bolt second end.

18. The method of claim 14 wherein fluid pressure is applied to said bore through said installation device.

19. A rock bolt system comprising: a rock bolt as defined in claim 1; an adhesive or cement filled cartridge located in said bore; and a rock bolt installation device, adapted to engage said rock bolt at or adjacent said rock bolt second end, pressurize said bore and rotate said rock bolt.

20. A rock bolt assembly for use with a hole and comprising:

a tubular body having a first end sized for insertion in the hole, a second end, and a bore extending through the first end to the second end, the bore sized to receive an adhesive or cement filled cartridge, a plug disposed in the bore and sized to seal the bore, the plug being displaceable along the bore from a position adjacent the second end to a position adjacent the first end to advance the cartridge along the bore;

a bolt head disposed adjacent the second end; and a detent and spring clip assembly carried by cooperating portions of the tubular body and the plug, the detent and spring clip assembly sized to restrain the plug in the position adjacent the first end of the tubular body.

* * * * *